United States Patent [19]

Knight et al.

[11] Patent Number: 4,804,042

[45] Date of Patent: Feb. 14, 1989

[54] BOTTOM HOLE SHUT-IN TOOL

[75] Inventors: Robert C. Knight, Page, Ariz.; Gerald W. Haws, Littleton, Colo.

[73] Assignee: Marathon Oil Company, Findlay, Ohio

[21] Appl. No.: 124,736

[22] Filed: Nov. 24, 1987

[51] Int. Cl.[4] ..... E21B 33/28; E21B 34/12

[52] U.S. Cl. ..... 166/184; 166/192; 166/324; 166/250; 277/169

[58] Field of Search ..... 166/179, 184, 185, 192, 166/250, 324, 332; 175/50; 277/169

[56] References Cited

U.S. PATENT DOCUMENTS

| | | | |
|---|---|---|---|
| 2,531,258 | 11/1950 | Cranfill | 166/184 |
| 3,249,372 | 5/1966 | Pollack | 277/169 |
| 3,381,751 | 5/1968 | McLelland | 166/65 |
| 3,540,744 | 11/1970 | Chen | 277/169 |
| 3,542,126 | 11/1970 | Owen | 166/65 |
| 3,587,735 | 6/1971 | Owen | 166/129 |
| 4,415,028 | 11/1983 | Watkins | 166/206 |
| 4,453,599 | 6/1984 | Fredd | 166/250 |
| 4,519,457 | 5/1985 | Holland | 166/332 |
| 4,669,537 | 6/1987 | Rumbaugh | 166/332 |

OTHER PUBLICATIONS

I. I. Gazda and H. L. Cantlon, "Downhole Shut-Off Tool," SPE Symposium on Low-Permeability Gas Reservoirs, May 20-22, 1979, Denver, Colo., pp. 335-341.

*Primary Examiner*—Jerome W. Massie
*Assistant Examiner*—Terry Lee Melius
*Attorney, Agent, or Firm*—Jack L. Hummel; Rodney F. Brown

[57] ABSTRACT

A bottom hole shut-in tool incorporating a ball and seat shut-off valve and a ball and seat pressure equalizing valve. The ball elements of the valves are formed of elastomeric material, which allows the ball elements to engage their seats in continuous annular sealing contact even when debris from the well is trapped between a ball and its seat or when a ball is not exactly aligned with its seat. This arrangement effectively seals off the pressure gauge used in conducting a pressure survey from fluid in the well tubing located above the shut-off valve.

8 Claims, 3 Drawing Sheets

BOTTOM HOLE SHUT-IN TOOL

FIELD OF THE INVENTION

This invention relates to bottom hole shut-in tools. More particularly, it relates to an improved bottom hole shut-in tool which effectively shuts off fluid flow in the tubing of a fluid well even under adverse conditions.

BACKGROUND OF THE INVENTION

It is often necessary to conduct bottom hole pressure surveys in fluid wells to obtain data which can be used by analysts to determine the characteristics of the wells and producing formations. This is especially important in the case of injection wells, where continual monitoring of the well conditions is essential in determining whether the injection operation will continue unaided or whether a well stimulation program should be undertaken.

Since the pressure near the formation face most accurately reflects actual conditions in the well, it is common practice to use a bottom hole shut-in tool to seal the pressure gauge from fluid in the wellbore above it. This exposes the gauge only to the fluid below the level of the shut-in tool, thus avoiding errors in the analysis caused by wellbore storage. This procedure is effective, however, only to the extent that the shut-in tool is capable of completely closing off the tubing to the passage of fluid. If the shut-in tool and the seating nipple conventionally provided to receive the shut-in tool are misaligned, or if sediment or other debris is trapped between the usual O-ring seal and the seating nipple, the fluid passageway in the tubing often is not effectively sealed, resulting in inaccurate readings.

It would therefore be desirable to have a bottom hole shut-in tool which is capable of effecting a seal even under conditions of misalignment and trapped debris. It would also be desirable for such a shut-in tool to be simple in design and easy to use.

BRIEF SUMMARY OF THE INVENTION

This invention provides a concave arcuate seat in the seating portion of the tubing which surrounds the fluid passageway in the tubing. The valve body of the shut-in tool has a convex arcuate lower end portion substantially conforming in shape to that of the arcuate seat, and is comprised of elastomeric material adapted to effect a seal when engaged with the arcuate seat. In addition, the valve body contains a cavity and a connecting bore through which fluid flows in its travel to the pressure gauge. The lower portion of the cavity comprises a concave arcuate seat surrounding the bore. A pressure equalizing relief plug in the cavity has an elastomeric convex arcuate lower end portion substantially conforming to the shape of the arcuate seat of the cavity to effect a seal when the pressure eqaalizing valve is closed. The relationship of the elastomeric ball valve elements and their associated valve seats provides for an effective seal even under the adverse conditions referred to above.

Other features and aspects of the invention, as well as its various benefits, will be ascertained from the more detailed description of the invention which follows.

DESCRIPTION OF THE PREFERRED EMBODIMENT

Figure 1:
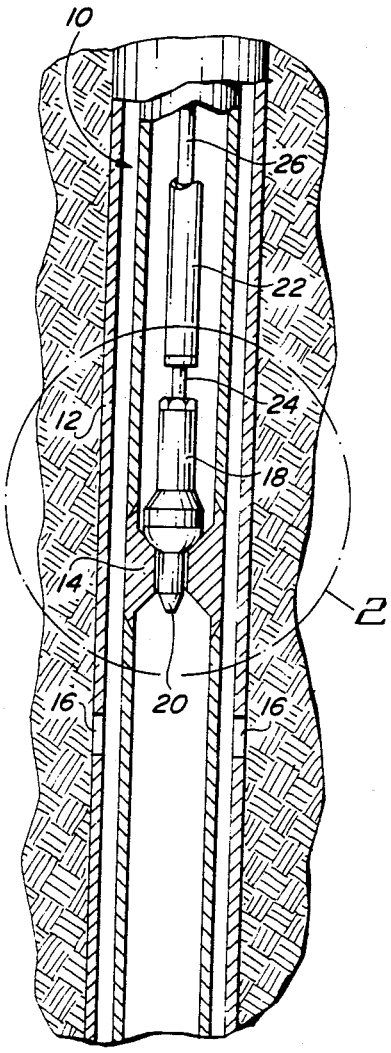
FIG. 1 is a longitudinal cross-sectional view of a portion of a fluid well bore incorporating a tubing string which includes the bottom hole shut-in tool of the present invention.

Referring to FIG. 1, a tubing string 10 is shown located within a well casing 12. A seating nipple 14, which forms part of the tubing string, is located a short distance above casing perforations 16 through which fluid passes from the surrounding formation. A shut-off valve body 18 connected to a probe 20 is shown seated in place in the seating nipple 14, with the probe extending through a passageway in the nipple so as to be exposed to fluid pressure in the region near the inlet perforations 16. The valve body 18 is connected to the lower end of a hollow adapter 22 by a stem 24, and the adapter is connected at its upper end to a conventional tool string 26. The hollow adapter 22 contains a pressure gauge or sensor, not shown, which is exposed to fluid from below the shut-off valve by a fluid passageway extending through the stem 24, the valve body 18 and the probe 20. The pressure gauge, which may be of any convenient type well known in the art, may be connected to recording instruments on the surface by means also well known in the art.

Figure 2:
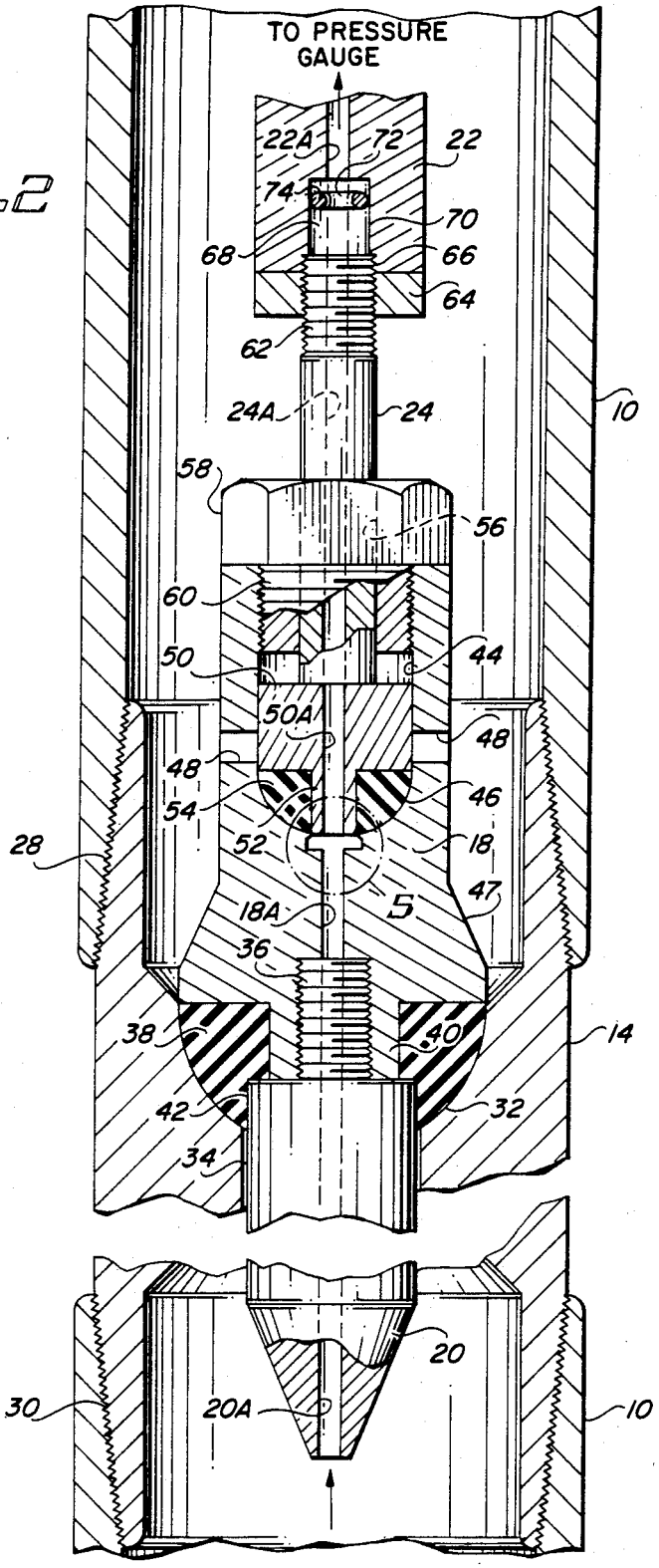
FIG. 2 is an enlarged longitudinal cross-sectional view of the portion of the tubing containing the shut-in tool of the present invention, wherein some of the components of the tool are shown in side elevation for purpose of clarity.

Referring to FIG. 2, the seating nipple 14 is shown as being connected to the tubing 10 by suitable threaded connections 28 and 30. The seating nipple is provided with a concave arcuate seating surface 32 which surrounds an opening 34 extending downwardly through the central portion of the nipple. The probe 20, which is connected to the valve body 18 by a threaded shaft or stem 36, extends through the opening 34 and into the region of the tubing below the seating nipple, the diameter of the probe being slightly less than the diameter of the opening 34 so as to be able to move through the opening 34 when lowered into place. A bore 20A extends through the probe and stem.

Figure 3:
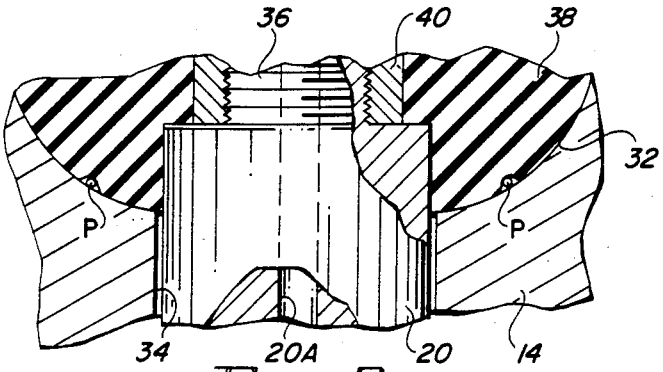
FIG. 3 is a more enlarged longitudinal cross-sectional view of the engaged portions of the ball and seat elements of the shut-off valve, showing the deformation of the elastomeric ball element around particles lodged between the ball and the valve seat.

The lower portion 38 of the valve body 18 is comprised of elastomeric material the outer surface of which is of convex arcuate shape conforming to the concave arcuate surface 32 of the seating nipple to form the ball element of a ball and seat type valve. The valve body 18 is shown in FIG. 2 in its fully seated position, contacting the arcuate surface 32 substantially along its entire surface. It will readily be understood that if sediment or bits of other types of debris are lying on the arcuate surface 32 of the valve seat when the elastomeric lower portion of the valve body 18 is lowered into contact with the seat, the ability of the elastomeric material to deform around the particle and the large expanse of elastomeric surface remaining in contact with the arcuate seat permit the valve to effectively close the opening 34 despite the presence of the particles. This situation is illustrated more graphically in FIG. 3, wherein particles P are shown lodged between the arcuate surface 32 and the face of the elastomeric ball member 38. The elastomeric material has been deformed by the particles but still is in face-to-face contact with the surface 32 of the valve seat at other points along the seat. Thus at least one continuous line of sealing contact between the ball and seat elements, extending around any particles on the valve seat and completely enclosing the opening 34, is almost certain to exist, thereby ensuring the sealing of the opening 34.

Figure 4:
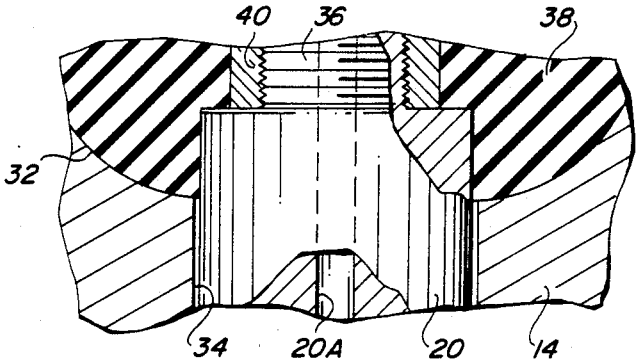
FIG. 4 a cross-sectional view similar to that of FIG. 3, but showing the elastomeric ball seated on the valve seat even though they are out of alignment.

The elastomeric material of the ball element also provides for a sealing relationship with the surface 32 of the valve seat in the event the probe 20 enters the opening 34 off center. This situation is illustrated in FIG. 4, wherein the probe is shown as being virtually in contact with the wall of the opening on the right side of the drawing but spaced a substantial distance from the wall of the opening on the left side of the drawing. Not only does the elastomeric material still completely cover the upper end of the opening, but it still substantially conforms to the concave surface 32 of the valve seat even though the curvatures of the elastomeric ball member and the valve seat are not exactly the same at their points of contact as they would be if they were properly aligned. The compressibility of the elastomeric material permits sufficient deformation under the weight of the tool string to which the valve body 18 is attached so that face-to-face sealing contact is still achieved and maintained.

Any elastomeric material of the type able to resist the stresses to which it is exposed during use and which has a hardness enabling it to be sufficiently compressible so as to deform about a particle encountered on the valve seat may be used as the ball element in the ball and seat shut-off valve. Elastomeric material of the type conventionally utilized in hydraulic rod pumps, such as a fluoroelastomeric material marketed by E. I. duPont de Nemours & Co., Inc. under the name VITON, is an example of suitable material which can be used. The hardness of such material is about 70 durometers.

Referring back to FIG. 2, the threaded stem 36 of the probe 20 is received by an internally threaded hollow nipple 40 which may also contain fine threads on its outer surface for engagement with the elastomeric end portion 38. The elastomeric portion is counterbored at 42 an amount equal to the diameter of the probe so as to snugly receive the upper part of the probe. Although the arrangement by which the probe and the elastomeric material are connected to the valve body has been found to be simple and effective, obviously other suitable arrangements could be used as well.

Figure 5:
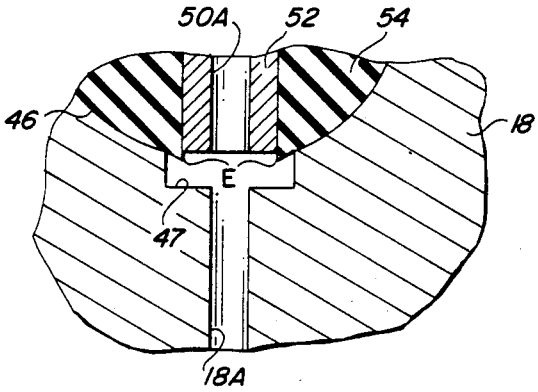
FIG. 5 is an enlarged longitudinal cross-sectional view of the engaged ball and seat elements of the pressure equalizin valve.

Contained in the valve body 18 is a cavity 44 the lower portion of which forms a concave arcuate surface 46 surrounding a small well or counterbore 47 in the valve body 18. Apertures 48 connect the cavity with the space within the tubing 10 above the seating nipple 14. Mounted for longitudinal slidable movement within the cavity is a pressure equalizing relief plug 50 having a hollow nipple 52 for connecting the plug to an elastomeric lower portion 54. The elastomeric material, which may be of the same type as that used for the lower portion 38 of the valve body 18, has a convex arcuate outer surface conforming to the arcuate surface 46 of the cavity 44. The bottom portion of the cavity thus acts as a valve seat for the ball or convex arcuate elastomeric lower portion of the plug 50, ensuring a proper seal in the same manner as the shut-off valve. As shown in both FIGS. 2 and 5, the elastomeric material extends downwardly a short distance below the bottom of the nipple 52 and a short distance radially inwardly of the circumference of the well 47. With this configuration, the lowermost end portion E of the elastomeric material is deformed downwardly from the upper edge of the well 47 when the elastomeric ball member is seated in the bottom portion of the cavity to further ensure an effective seal when the pressure equalizing valve is closed.

The stem 24 extends upwardly from the relief plug 50, passing through a bore 56 in both the lock nut 58 and the threaded shank 60 depending from the lock nut. The lock nut 58 acts to close off the open end of the cavity 44 in the valve body 18. The stem 24 has a threaded end 62 connected to lock nut 64 and to a threaded bore 66 in adapter 22, and a reduced end portion 68 terminating in adapter bore 70. A groove 72 in the end portion 68 receives O-ring 74, which prevents fluid from passing through the bore 70.

The valve body 18, the relief plug 50 and the stem 24 contain centrally located bores 18A, 50A and 24A, respectively, which are aligned with each other and with bore **20*a* in the probe 20 so as to form a continuous bore through the tool. The adapter 22 also contains a bore 22A aligned with the bore 24A so that fluid below the seating nipple 14 has a flow path through the bores and into the hollow adapter 22** in which the pressure gauge is located.

Figure 6:
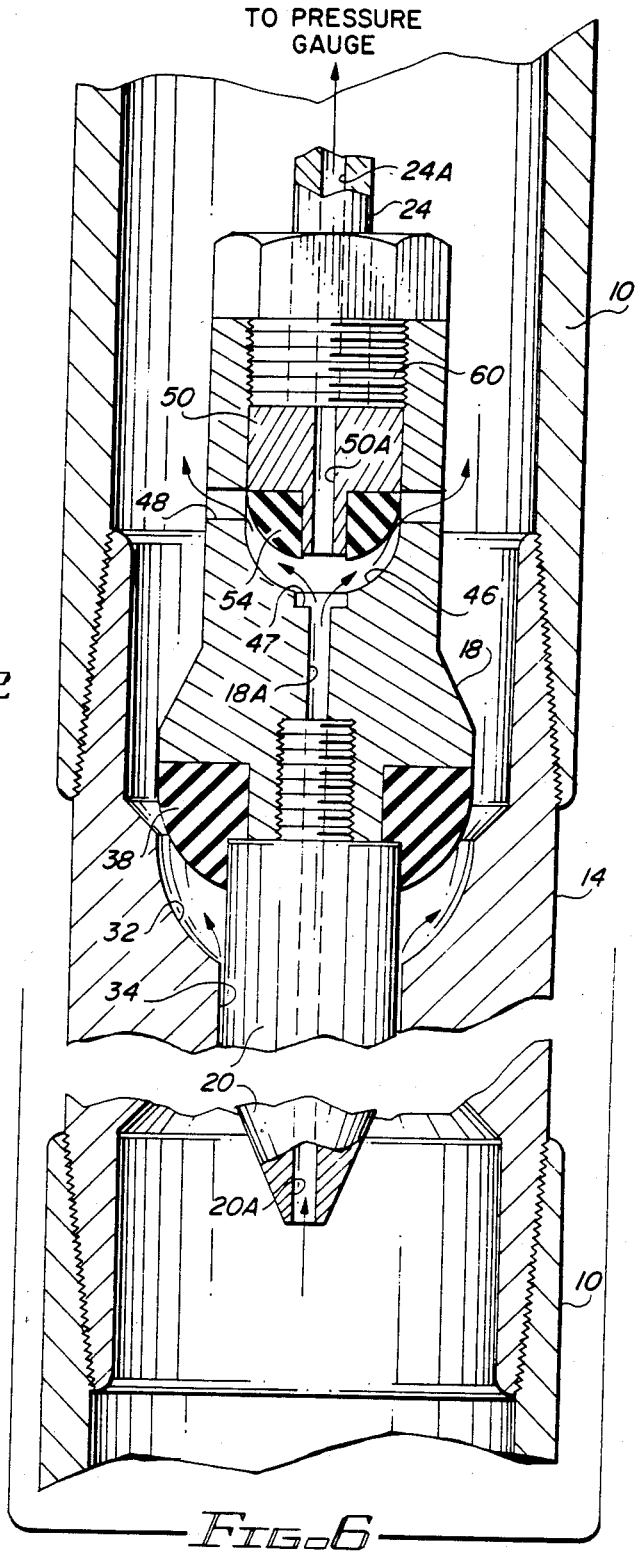
FIG. 6 is an enlarged longitudinal cross-sectional view similar to that of FIG. 2, but showing the shut-off valve and the pressure equalizing valve in open condition.

Referring now to FIG. 6, both the shut-off valve and the pressure equalizing valve are shown in their open condition. The pressure equalizing valve would be open when the probe is being lowered into place through the tubing 10 and when it is being raised through the tubing after the pressure survey has been completed. This is necessary in order to equalize the pressure above and below the valve body 18 so that the valve body and probe can be moved through the tubing. The pressure equalizing valve is opened simply by pulling up on the tool string attached through the adapter to the stem 24. Conversely, the weight of the tool string is sufficient to maintain the pressure equalizing valve in closed condition when the valve body is in place. Although it would not normally be necessary, if desired the longitudinal dimension of the cavity could be increased and a compression spring introduced between the top of the plug 50 and the lower surface of the shank 60. In such an arrangement the spring would urge the relief plug toward the cavity seat, assisting to maintain the pressure equalizing valve in closed condition.

Referring to both FIGS. 2 and 6, it can be seen that if the ball element 54 of the pressure equalizing relief plug were not capable of forming a fluid-tight seal with the cavity seat 46, fluid would flow between the ball and seat, out the apertures 48 and up through the tubing 10, thereby adversely affecting the pressure readings. Similarly, if the ball element 38 of the shut-off valve were not capable of forming a fluid-tight seal with the seat 32, fluid would flow between the ball and seat and up through the tubing 10, also adversely affecting the pressure readings.

Although the shut-in tool has been described as being used in connection with a pressure gauge located in the hollow adapter 22, it should be understood that the tool could be used in connection with a pressure gauge located below the shut-off valve. In such an arrangement the conductor wire leading to the gauge would extend down through the bores 24A, 50A, 18A and 20A, and the stem of the relief valve surrounding the bore would be provided with suitable sealing means, such as O-rings and packing material, to prevent flow of fluid through the bore 24A.

It should now be clear that the shut-in tool of the present invention provides a simple but very effective positive sealing means for both the shut-off valve and the pressure equalizing valve of the tool. The face-to-face contact of the elastomeric ball elements with their seat elements provides a seal even though the elements may be slightly misaligned or separated at points by particles of sediment or other debris, thus isolating the pressure gauge and permitting an accurate pressure survey to be made in a fluid well.

It should be obvious that although a preferred embodiment of the invention has been described, changes to certain of the specific details of the embodiment may be made without departing from the spirit and scope of the invention as defined by the claims.

What is claimed is:

1. A bottom hole shut-in tool for preventing fluid flow in tubing extending within a fluid wel bore, comprising:

a concave arcuate seat in a portion of the tubing, the arcuate seat surrounding a fluid passageway;

a valve body having a convex arcuate lower end portion substantially conforming in shape to that of the arcuate seat;

the arcuate lower end portion of the valve body being comprised of an elastomeric material adapted to seal against fluid flow through the passageway when engaged with the arcuate seat;

a probe extending downwardly from the valve body and into the fluid passageway, the valve body and the probe containing aligned bores through which fluid may flow;

the valve body containing a cavity connecting with the bore in the valve body, the valve body further including pressure equalizing valve means in the cavity; and the valve body further containing at least one aperture connecting the cavity with the space between the valve body and the tubing, the pressure equalizing valve means comprising plug means for blocking fluid flow from the cavity to the apertures, the cavity containing a concave arcuate seat portion surrounding the bore in the valve body and the plug means having a convex arcuate lower end portion substantially conforming in shape to that of the arcuate seat portion of the cavity.

2. A bottom hole shut-in tool according to claim 1, wherein the arcuate lower end portion of the pressure equalizing valve plug means is comprised of an elastomeric material adapted to seal against fluid flow through the bore when engaged with the arcuate seat portion of the cavity.

3. A bottom hole shut-in tool according to claim 2, wherein the pressure equalizing valve plug means includes a downwardly extending stem attached to the elastomeric arcuate lower end portion of the plug means, the elastomeric material extending beyond the lowermost end of the stem.

4. A bottom hole shut-in tool according to claim 3, wherein the bore in the valve body is connected to the arcuate seat portion of the cavity by a counterbore, the elastomeric material of the arcuate lower end portion of the plug means extending slightly radially inwardly of the arcuate seat portion of the cavity toward the counterbore when the pressure equalizing valve is in sealing condition.

5. In a fluid well bore containing a string of tubing, the tubing containing a pressure gauge connected by a fluid passageway to a shut-in tool, the improvement comprising:

a concave arcuate seat in a portion of the tubing;

the arcuate seat surrounding a fluid opening;

a valve body through which the fluid passageway extends;

the valve body containing a cavity;

the lowermost portion of the cavity forming a concave arcuate seat surrounding the fluid passageway;

an elastomeric convex arcuate surface on the lower end portion of the valve body substantially conforming in shape to the arcuate seat of the tubing;

a pressure equalizing valve plug having an elastomeric convex arcuate surface on the lower end portion thereof substantially conforming in shape to the arcuate seat of the cavity; and the valve body containing at least one aperture connecting the cavity with the space between the valve body and the tubing;

the elastomeric arcuate surface of the valve body sealing the fluid opening when seated on the arcuate seat of the tubing and the elastomeric arcuate surface of the pressure equalizing valve plug preventing fluid flow to the apertures when seated on the arcuate seat of the cavity, to thereby expose the pressure gauge only to pressure from fluid located below the arcuate seat of the tubing.

6. In a fluid well bore according to claim 5, further including stem means attached to the pressure equalizing valve plug and extending upwardly beyond the valve body, whereby the plug can be unseated by pulling up on the stem means.

7. In a fluid well bore according to claim 6, wherein the fluid passageway extends through the valve body, the pressure equalizing valve plug and the stem means.

8. A bottom hole shut-in tool for preventing fluid flow in tubing extending within a fluid well bore, comprising:

a concave arcuate seat in a portion of the tubing, the arcuate seat surrounding a fluid passageway;

a valve body having a convex arcuate lower end portion substantially conforming in shape to that of the arcuate seat;

tubular means extending downwardly from the valve body beyond the convex arcuate lower end portion thereof and into the fluid passageway, the valve body an the tubular means containing connecting bores through which fluid may flow;

the arcuate lower end portion of the valve body being comprised of an elastomeric material adapted to seal against fluid flow through the passageway when engaged with the arcuate seat, the elastomeric material having a hardness permitting the elastomeric material to be deformed by particles lodged between the arcuate lower end portion of the valve body and the arcuate seat while still remaining in sealing contact with the arcuate seat; and the valve body containing a cavity connecting with the bore in the valve body, the cavity including a concave arcuate seat portion and containing pressure equalizing valve means, the pressure equalizing valve means including a convex arcuate lower end portion comprised of elastomeric material having a hardness permitting the elastomeric material to be deformed by particles lodged between the arcuate lower end portion of the pressure equalizing valve means and the arcuate seat portion of the cavity while still remaining in sealing contact with the arcuate seat portion of the cavity.

* * * * *